US006254214B1

(12) United States Patent
Murthy et al.

(10) Patent No.: US 6,254,214 B1
(45) Date of Patent: Jul. 3, 2001

(54) SYSTEM FOR COOLING AND MAINTAINING AN INKJET PRINT HEAD AT A CONSTANT TEMPERATURE

(75) Inventors: Ashok Murthy, Tualatin, OR (US); Carl Edmond Sullivan, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/330,716

(22) Filed: Jun. 11, 1999

(51) Int. Cl.[7] ..... B41J 29/38
(52) U.S. Cl. ..... 347/17
(58) Field of Search ..... 347/17, 65, 84, 347/18, 63, 44, 57, 58, 59, 50, 20, 14, 23, 19

(56) References Cited

U.S. PATENT DOCUMENTS

| | | | |
|---|---|---|---|
| 4,412,224 | 10/1983 | Sugitani | 341/65 |
| 4,580,147 | 4/1986 | Deyoung et al. | 346/140 |
| 4,894,662 | 1/1990 | Tsung Pan | 346/1.1 |
| 4,899,180 | 2/1990 | Elhatem et al. | 346/140 |
| 4,994,826 | 2/1991 | Tellier | 346/140 |
| 5,278,585 | 1/1994 | Karz et al. | 346/140 |
| 5,291,215 * | 3/1994 | Nozawa et al. | 347/18 |
| 5,387,314 | 2/1995 | Baughman et al. | 156/643 |
| 5,402,160 | 3/1995 | Kadowaki et al. | 347/18 |
| 5,459,498 | 10/1995 | Seccombe et al. | 347/18 |
| 5,502,471 | 3/1996 | Obermeier et al. | 347/65 |
| 5,506,608 | 4/1996 | Marler et al. | 347/18 |
| 5,582,678 | 12/1996 | Komuro | 216/27 |
| 5,594,481 | 1/1997 | Keefe et al. | 347/65 |
| 5,619,236 | 4/1997 | Keefe et al. | 347/84 |
| 5,622,897 | 4/1997 | Hayes | 438/21 |
| 5,623,292 | 4/1997 | Shrivastava et al. | 347/18 |
| 5,638,101 | 6/1997 | Keefe et al. | 347/65 |

* cited by examiner

*Primary Examiner*—John Barlow
*Assistant Examiner*—Charles W. Stewart, Jr.
(74) *Attorney, Agent, or Firm*—Staas & Halsey LLP

(57) ABSTRACT

A system for cooling an inkjet print head with the print head having a nozzle plate and heater chip. The nozzle plate contains a series of firing chambers and nozzles. The heater chip contains several heating elements and cooling channels. Ink is heated in the firing chambers and forced through the nozzles onto paper. A pump is employed to pump the ink from an ink reservoir through the cooling channels in the heater chip in order to maintain the heater chip at a constant temperature. When the printer is actively printing, at least a portion of the ink is returned to the reservoir. When the printer is not actively printing, ink is still pumped through the cooling channels to maintain the heater chip at the proper temperature.

19 Claims, 10 Drawing Sheets

SYSTEM FOR COOLING AND MAINTAINING AN INKJET PRINT HEAD AT A CONSTANT TEMPERATURE

BACKGROUND OF THE INVENTION

1. Field of the Invention

The present invention relates to a system for cooling and maintaining a print head used in an inkjet printer at a constant temperature. More particularly, the present invention relates to forming cooling channels in a heater chip of a print head and continuously pumping ink through these channels to maintain the heater chip at the proper operating temperature even when the printer is not actively printing.

2. Description of the Related Art

In recent years color inkjet printers have been developed for home and office use. These inkjet printers operate by using a heater chip to heat ink contained in firing (vaporization) chambers that open to a nozzle. Each firing chamber has individual heating elements associated therewith and when the printer processor determines that a particular chamber should fire, an electric current is applied to the associated heater element for that firing chamber. The ink in the firing chamber is then rapidly heated and a bubble of ink is deposited on the paper. The chamber is then refilled by a capillary feed mechanism from an ink reservoir.

During the printing process, the print head normally moves back and forth across the paper while printing. Since the print is moving while simultaneously printing, the timing of heating the firing chambers in the print head is critical to proper placement of the ink on the paper. When the print head operates for a period of time, heat tends to accumulate in the print head. When excessive heat accumulates, the firing chamber may prematurely eject the ink on the paper and the image may be distorted. In addition, excess heat may cause air bubbles to accumulate in the ink and prevent normal functioning of the jetting mechanism. Further, if the heat continues to accumulate then damage may occur to the heater chip itself, which would necessitate its replacement.

A mechanism that has been incorporated in inkjet printers to alleviate this problem has been to slow the printing speed and thereby reduce the firing rate for the individual firing chambers. Since more time elapses between repeated heating of the firing chambers, the heater chip maintains a constant temperature through simple radiation of the heat. Another approach has been to build in a time delay at the point at which the print head has completed one pass while the paper is moving to the next print position. Both of these solutions cause undesirable delays in printing.

Additional methods of maintaining the temperature of a heater chip at the proper level are disclosed in the prior art discussed below.

U.S. Pat. No. 5,619,236 to Keefe et al. describes a method of cooling a heater chip by using an edge feed rather than a center feed firing mechanism in which the ink passes along the back and around the edges of the substrate containing the heating elements. By allowing the ink to pass along the back and edges of the heater chip, heat may be drawn off from the heater chip by the ink.

U.S. Pat. No. 4,899,180 to Elhatem et al. discloses an inkjet print head in which a heater chip is used to heat ink and thereby discharge it onto paper. The device consists primarily of two silicon chips and temperature sensors. As shown in FIG. 4, the first silicon chip consists of a heater chip 30 and a second silicon chip acts as a channel chip 42 in which ink channels are etched therein. The ink channels lead directly to firing chambers and nozzles. Ink flows through the channel chip only when printing is actively taking place.

U.S. Pat. No. 4,994,826 to Tellier discloses a method of forming channels on a heater chip in which a film layer is placed on the chip and a portion of the film is then removed to form channels. A plate is then placed on the film to form closed channels and nozzle openings.

In all the foregoing patents some degree of cooling is achieved for the heater chip. However, in every case the cooling channels are not formed directly in the heater chip and in order for the cooling mechanism to operate the print head must be actively depositing ink on paper. Therefore, the cooling mechanism of the prior art is not particularly effective since the ink used in cooling does not come in close contact with the heat producing elements of the heater chip. More importantly, the cooling mechanism disclosed in the prior art only works when the printer is actually depositing ink on paper. At all other times there is no active cooling that takes place. Thus, it is still necessary to build in time delays and otherwise slow the printing process in order to insure that the heater chip remains at the proper temperature.

Therefore, a need exists for a simple and highly effective mechanism to maintain a heater chip at a desired temperature even when the printer is not actively printing. With a mechanism that is highly effective and continuously operates, it would be possible to print at the printer's maximum speed and be assured that the heater chip is maintained at the proper temperature.

SUMMARY OF THE INVENTION

An object of the present invention is to provide a system that cools and maintains a heater chip at a desired temperature even when the printer is not actively printing.

Objects and advantages of the present invention are achieved with the embodiments by a cooling system for a print head of an inkjet printer in which a heater chip has access to several firing chambers and nozzles. In addition, the heater chip has several cooling channels formed in the heater chip. When the inkjet printer is actively printing, ink is heated in the firing chambers and ejected through the nozzles. The cooling system also includes an ink reservoir containing ink and a pump connected to the heater chip and the ink reservoir. The pump is used to pump the ink from the ink reservoir through the cooling channels in the heater chip in order to cool the heater chip and then returns at least a portion of the ink to the ink reservoir.

In accordance with embodiments of the present invention, the pump continuously pumps ink through the cooling channels regardless of whether the inkjet printer is actively printing.

In accordance with embodiments of the present invention, the cooling system for the print head also includes a temperature sensor connected to the heater chip to read the temperature of the heater chip. It also contains a processor connected to the temperature sensor and the pump to receive the temperature of the heater chip from the temperature sensor. The processor will turn on the pump when the temperature of the heater chip exceeds a predetermined temperature range and turns off the pump when the temperature of the heater chip drops below the predetermined temperature range.

In accordance with further embodiments of the present invention, the cooling system for the print head also contains a center feed channel to connect the cooling channels to the firing chambers. When the firing chambers cause the ejection of ink from the nozzles, the firing chambers are refilled by capillary feed through the cooling channels.

In accordance with further embodiments of the present invention, the cooling channels are sized relative to the firing chambers and the nozzles to provide for smooth flow of ink. Through this sizing of the cooling channels relative to the firing chambers and nozzles leakage from the print head is prevented.

In accordance with embodiments of the present invention, the cooling system for a print head of an inkjet printer also includes several edge feed channels to connect the ink reservoir to the firing chambers. The edge feed channels also connect the ink reservoir to the cooling channels. Therefore, when the firing chambers cause the ejection of ink from the nozzles, the firing chambers are refilled by capillary feed from the ink reservoir.

In accordance with further embodiments of the present invention, the cooling channels are sized relative to the firing chambers and the nozzles to provide for smooth flow of ink via the edge feed channels. Through this sizing of the cooling channels relative to the firing chambers and nozzles, leakage from the print head is prevented.

Further objects and advantages of the present invention are achieved in accordance with embodiments of another cooling system for a print head of an inkjet printer. This cooling system includes a nozzle plate having several nozzles and firing chambers formed therein. It also includes a heater chip connected to the nozzle plate having several heating elements positioned adjacent to the firing chambers and cooling channels formed in the heater chip. When the inkjet printer is actively printing, ink is heated in the firing chambers and ejected through the nozzles of the nozzle plate. The cooling system also includes an ink reservoir containing ink and a pump connected to the heater chip and the ink reservoir. The pump pumps the ink from the ink reservoir through the cooling channels in the heater chip in order to cool the heater chip and then returns at least a portion of the ink to the ink reservoir.

Further objects and advantages of the present invention are achieved in accordance with embodiments of another cooling system for a print head of an inkjet printer. This cooling system includes a nozzle plate having several nozzles and firing chambers formed therein. It also has a heater chip connected to the nozzle plate having several heating elements positioned adjacent to the firing chambers. The cooling system further contains cooling channels formed in the heater chip. When the inkjet printer is actively printing, ink is heated in the firing chambers and ejected through the nozzles of the nozzle plate. The cooling system also has an ink reservoir containing ink. A pump is connected to the heater chip and the ink reservoir to pump the ink from the ink reservoir through the cooling channels in the heater chip in order to cool the heater chip. The pump will also cause the return of at least a portion of the ink to the ink reservoir. A temperature sensor connected to the heater chip is provided to read the temperature of the heater chip. A processor connected to the temperature sensor and the pump receives the temperature of the heater chip from the temperature sensor. The processor will turn on the pump when the temperature of the heater chip exceeds a predetermined temperature range and turn off the pump when the temperature of the heater chip drops below the predetermined temperature range.

BRIEF DESCRIPTION OF THE DRAWINGS

These and other objects and advantages of the invention will become apparent and more readily appreciated for the following description of the preferred embodiments, taken in conjunction with the accompanying drawings.

DESCRIPTION OF THE PREFERRED EMBODIMENTS

Figure 1:
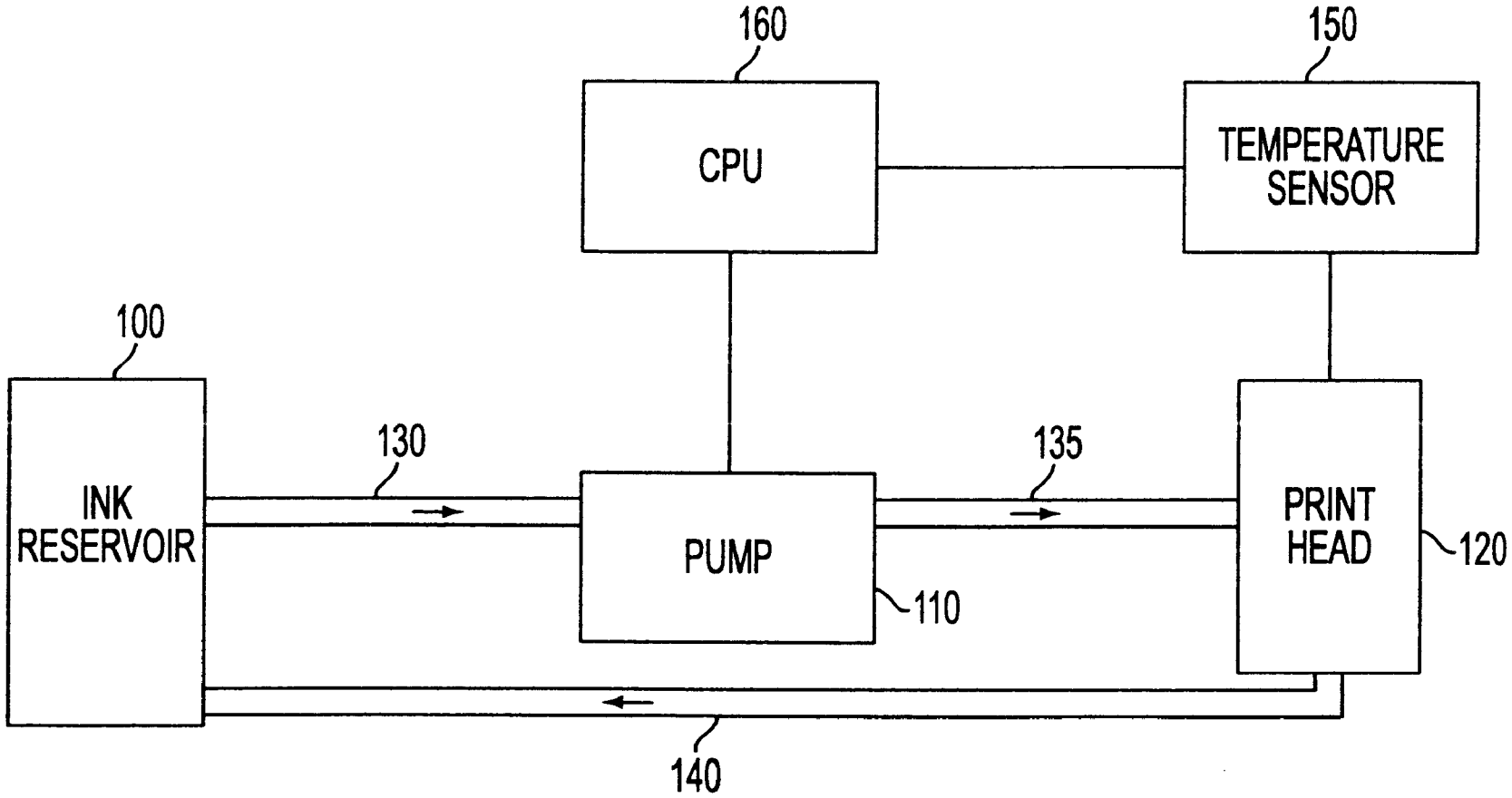
FIG. 1 is a block diagram showing the hardware configuration of a cooling system for a print head of an inkjet printer according to a preferred embodiment of the present invention.

Reference will now be made in detail to the preferred embodiments of the present invention, examples of which are illustrated in the accompanying drawings, wherein like reference numerals refer to like elements throughout.

FIG. 1 is a block diagram showing the hardware configuration for a cooling system for a print head of an inkjet printer according to a preferred embodiment of the present invention. An ink reservoir 100 is used to contain ink used in the printing process and cooling of a print head 120. The ink reservoir 100 is connected to a pump 110 through input feed channel 130. The pump 110 is a miniature electric pump that operates off the same current source as the heater chip (not shown). The pump is connected to the print head 120 through output feed channel 135. When the printer is turned on, the pump 110 pumps ink from the ink reservoir 100 to the print head 120 and then back to the ink reservoir 100 through return channel 140.

In an alternate embodiment of the present invention, a temperature sensor 150 is connected to heater chip 180 in order to read its actual temperature. The temperature sensor 150 is in turn connected to printer CPU 160 that receives the temperature readings. The preferred operating temperature range for the heater chip 180 is 30° C. to 50° C. Therefore, the printer CPU 160 may control the operation of the pump 110 so as to maintain the desired operating temperature.

Figure 2:
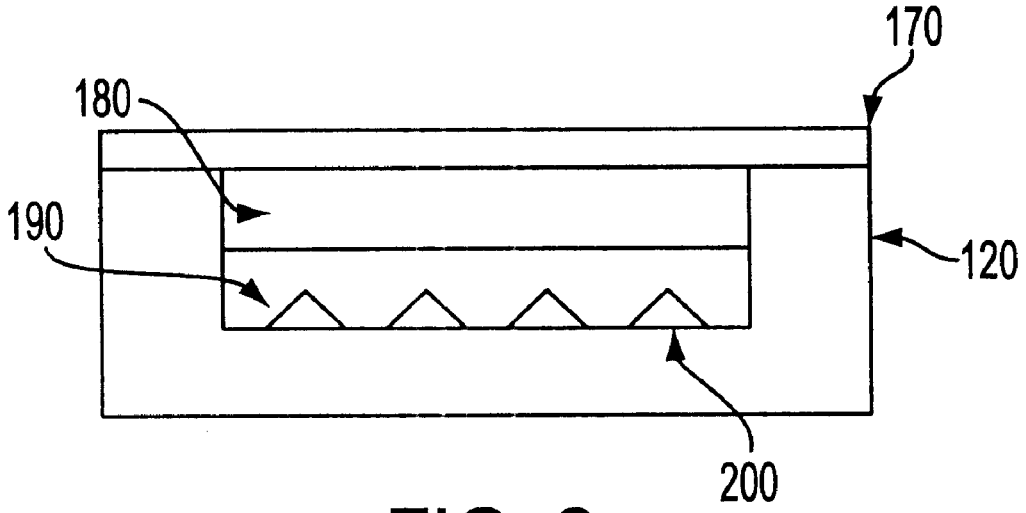
FIG. 2 is a diagram showing a side view of a print head having cooling channels etched in a silicon wafer according to an embodiment of the present invention.

FIG. 2 is a diagram showing a side view of a print head 120 in which cooling channels 200 are etched in a silicon wafer 190. A nozzle plate 170 is placed over the heater chip 180 and completes the print head 120. It should be noted that in this embodiment, the cooling channels 200 do not come into direct contact with the heater chip 180.

Figure 3:
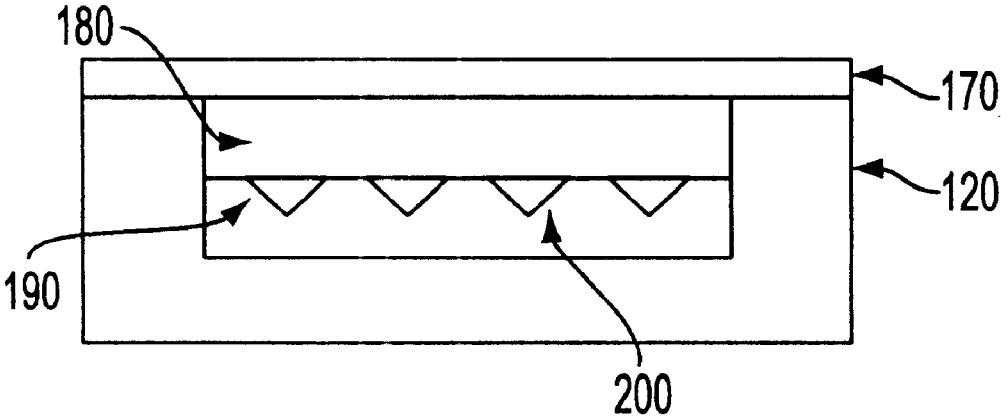
FIG. 3 is a diagram showing a side view of a print head having cooling channels etched in a silicon wafer so that they come in direct contact with a heater chip according to an embodiment of the present invention.

FIG. 3 is a diagram showing a side view of print head 120 having cooling channels 200 etched in a silicon wafer 190 so that they come in direct contact with a heater chip 180. In this preferred embodiment the cooling channels 200 come in direct contact with the heater 180 and thereby are more effective in cooling the heater chip 180.

Figure 4:
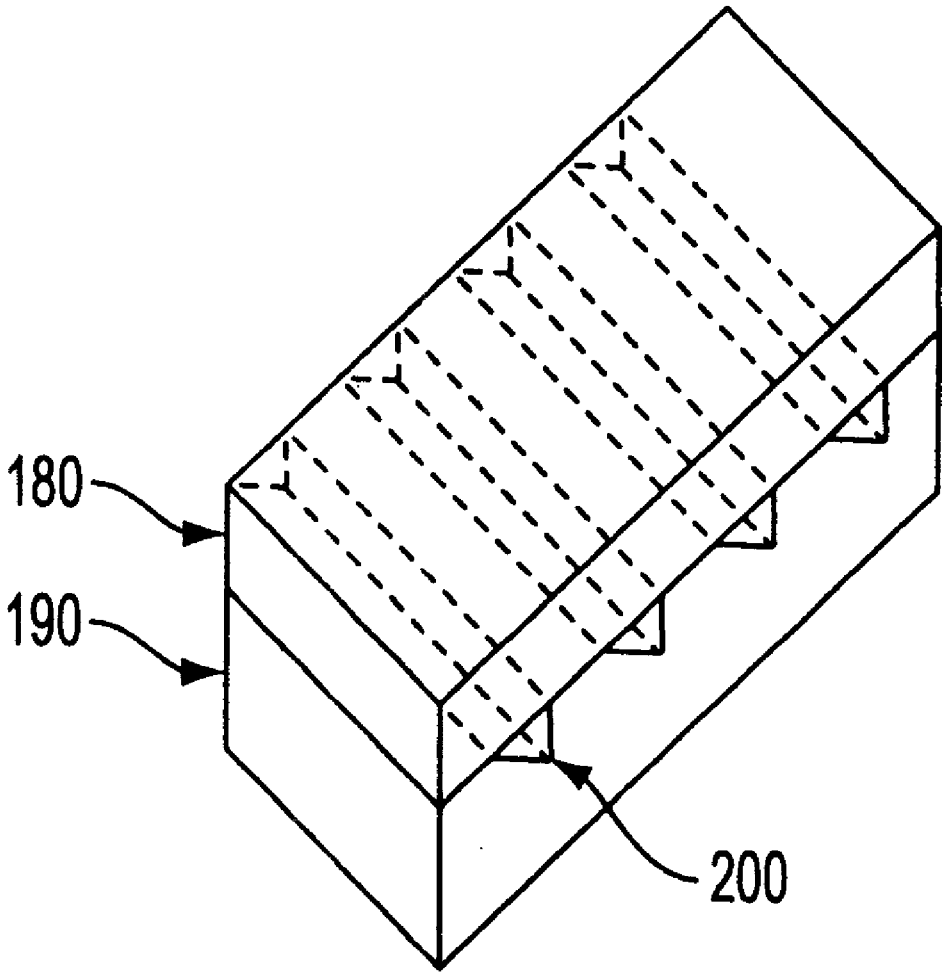
FIG. 4 is a diagram showing a three dimensional top view of FIG. 3 showing cooling channels etched in a silicon wafer so that they come in direct contact with a heater chip according to a preferred embodiment of the present invention.

FIG. 4 is a diagram showing a three dimensional top view of FIG. 3 in which cooling channels 200 are etched in a silicon wafer 190 so that they come in direct contact with a heater chip 180. It should be noted that the cooling channels 200 run the entire length of the silicon wafer 190 and the heater chip 180. In addition, it should be noted that the cooling channels 200 are spaced as close as possible to one another so that maximum cooling of the heater chip 180 is achieved.

Figure 5:
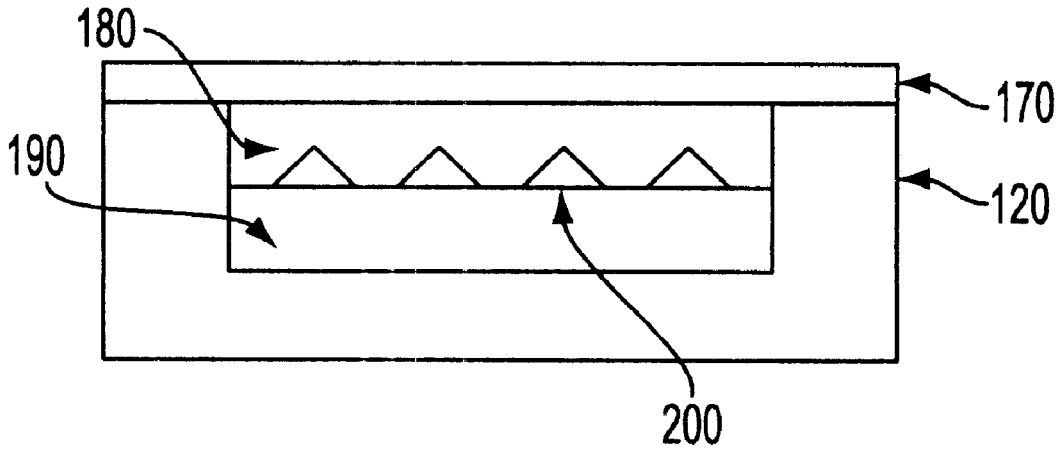
FIG. 5 is a diagram showing a side view of cooling channels etched directly in a heater chip according to an embodiment of the present invention.

FIG. 5 is a diagram showing a side view of cooling channels 200 etched directly in a heater chip 180 according to an embodiment of the present invention. In this embodiment, maximum cooling of the heater chip 180 is possible since the ink comes as close as possible to the heat producing elements (not shown) in the heater chip 180. However, a particular method must be taken when etching the cooling channels 200 so as not to damage any of the heating elements in the heater chip 180.

The method of creating the cooling channels 200 in the heater chip 180 or silicon wafer 190 may use any one of several techniques known in the art. These techniques may include laser ablating using a mask or chemical etching using a mask. However, as would be appreciated by a person of ordinary skill in the art, any technique that can precisely remove material on an extremely small scale is suitable in creating the cooling channels 200.

Figure 6:
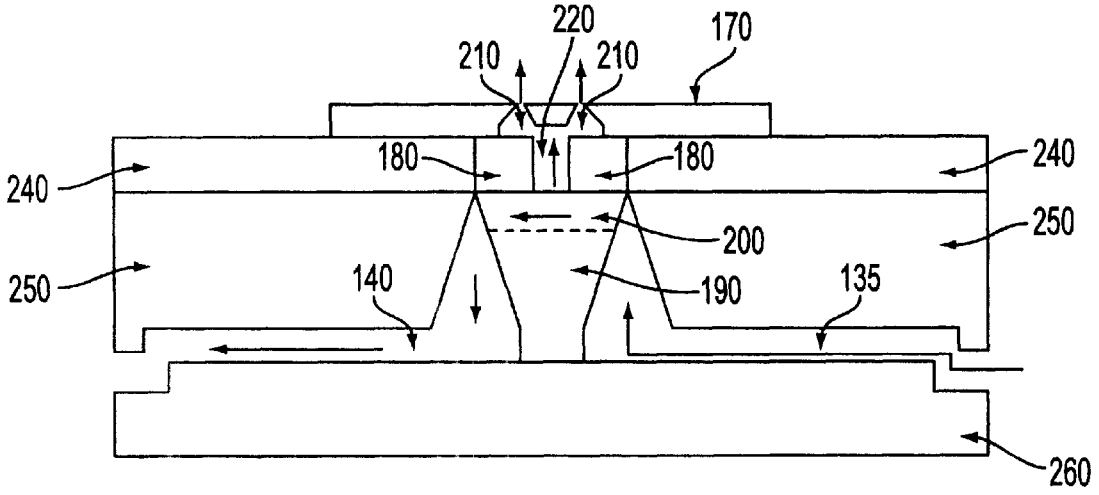
FIG. 6 is a diagram showing in detail the inkjet print head shown in FIG. 1 using center feed channels and cooling channels according to a preferred embodiment of the present invention.

FIG. 6 is a diagram showing in detail a side view of print head 120 (shown in FIG. 1) using a center feed channel 220 and cooling channels 200 according to a preferred embodiment of the present invention. Ink enters the print head through output feed channel 135 from pump 110 shown in FIG. 1. The ink, due to the pumping force from pump 110, proceeds through cooling channels 200 where the ink absorbs heat contained in the heater chip 180. When the print head 120 is not actively printing, the heated ink then proceeds through return channel 140 to ink reservoir 100 shown in FIG. 1.

As discussed earlier, in the preferred embodiment the pump 110 continuously operates whenever the inkjet printer is turned on. However, in the alternate embodiment discussed earlier a temperature sensor 150 (shown in FIG. 1) coupled to the printer CPU 160 (shown in FIG. 1) may be used to control pump 110 and only turn it on when the heater chip 180 exceeds a certain temperature.

Figure 9:
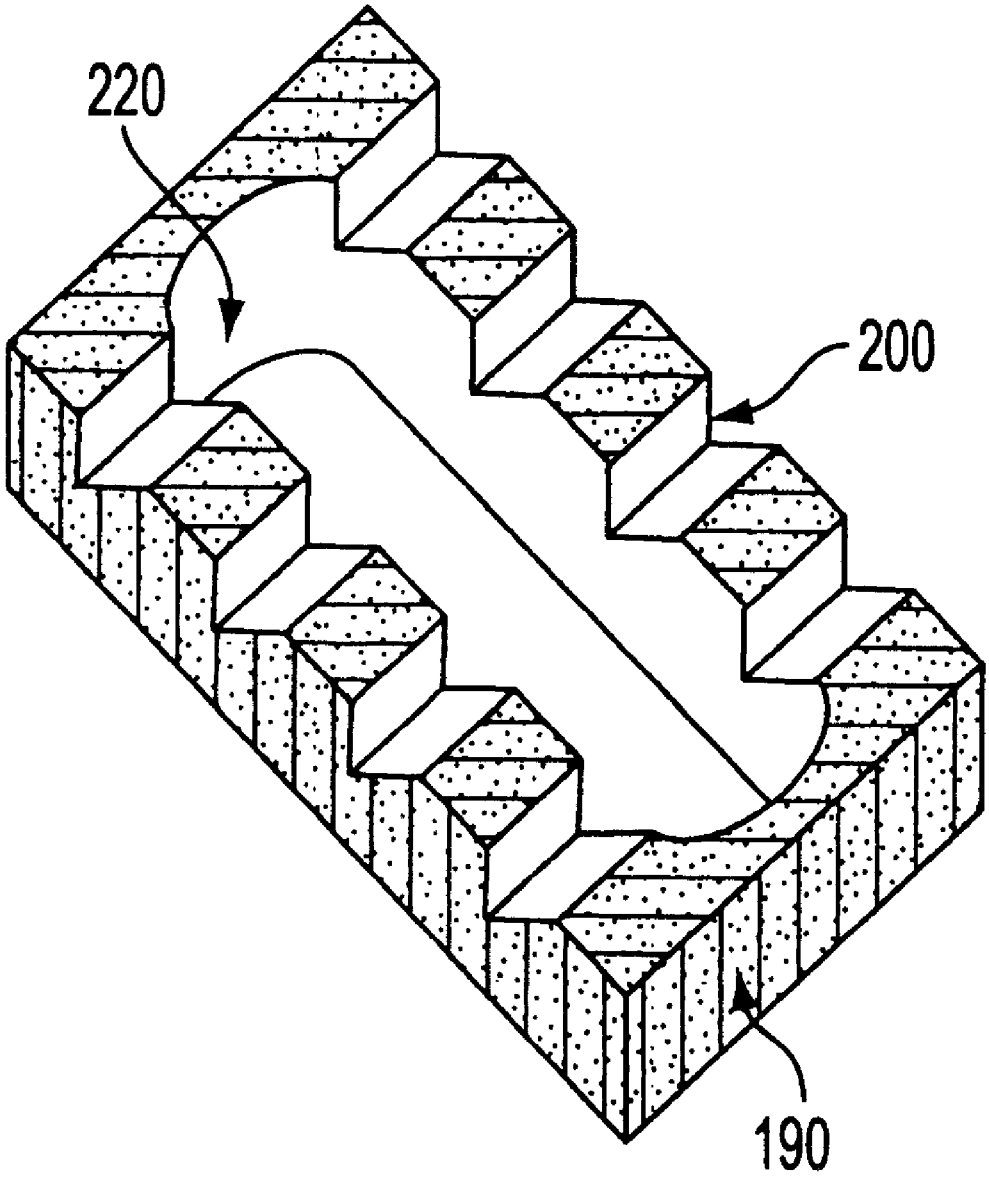
FIG. 9 is a diagram showing a three dimensional top view of etched cooling channels with a center feed channel in a silicon wafer for use in a center feed inkjet print head as shown in FIG. 6.

In FIG. 6, when the print head is actively printing, current is applied to heating elements (not shown) located in heater chip 180 which are immediately below firing chambers 210 located in the nozzle plate 170. The firing chambers 210 also contain nozzles that eject the ink onto the print medium when the ink reaches a vaporization temperature. The firing chambers 210 are refilled with ink by capillary feed through center feed channel 220. As shown in FIG. 9, the center feed channel 220 connects to the cooling channels 200 in the silicon wafer 190 and receives ink from cooling channels 200.

The sizing of the center feed channel 220 versus the cooling channels 200 is important in order to prevent undesired leakage of ink since the pump 110 may be pumping ink even when the print head is not printing. Ink is composed of primarily water and travels like current through the path of least resistance. In order to prevent ink from being forced out of the firing chambers 220 through the pumping action of pump 110, the center feed channel 220 should be sized to apply sufficient resistance to prevent this. However, not so much resistance should be provided by the center feed channel 220 that capillary feed of ink into the firing chambers 220 is defeated. A person of ordinary skill in the art would appreciate that sizing the cooling channels 200 should provide for the smooth flow of ink to the firing chambers 220, but that the firing chambers 220 along with their associated nozzles should be sized to provide sufficient resistance to prevent leakage therefrom due to the pumping action of pump 110.

Figure 10A:
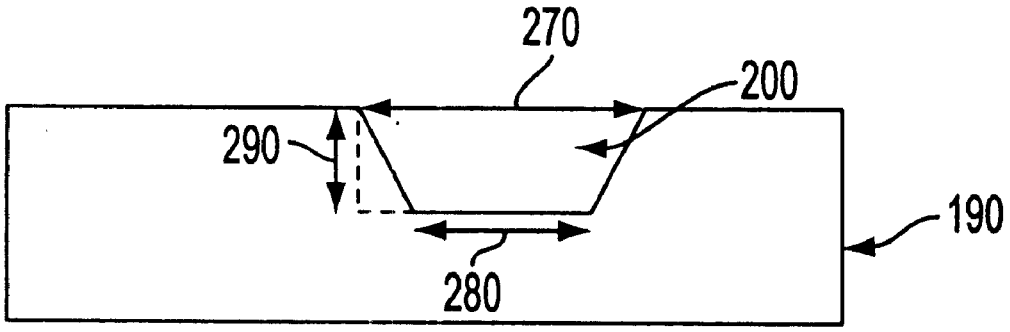
FIG. 10A is a diagram showing a side view of a cooling channel etched in a silicon wafer along with its entrance width, exit width and depth according to an embodiment of the present invention.
Figure 10B:
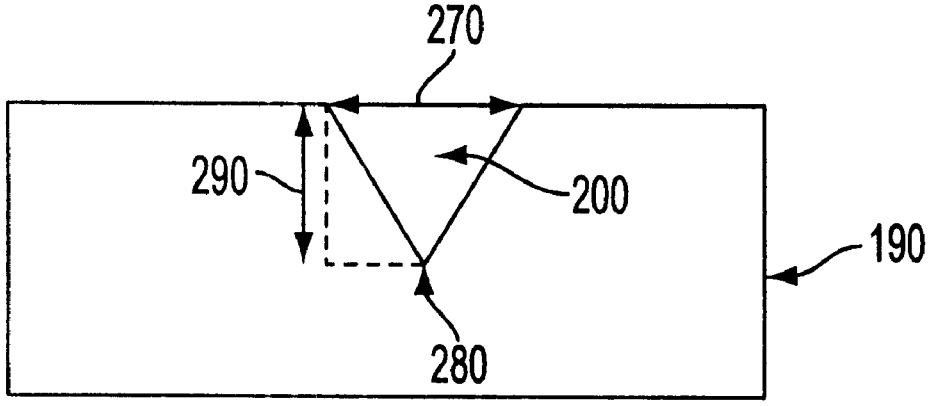
FIG. 10B is a diagram showing a side view of a cooling channel etched in a silicon wafer along with its entrance width, exit width and depth according to a preferred embodiment of the present invention.

Determining the volume of the center feed channel 220 as shown in FIG. 9 is a matter of multiplying its height by its width since it is approximately rectangular in shape. When the cooling channels 200 are formed by Potassium Hydroxide (KOH) solution etching, the sizing of cooling channels 200 can then be determined based on the formula W-entrance=W-exit+SQRT(2)*D. Referring to FIG. 1 OA and I OB, the cooling channels 200 are shown with two alternative embodiments of differing shape. In FIG. 10A and 10B, W-entrance corresponds to item 270 which is where the etching process would start. W-exit corresponds to item 280 and is the width where the etching ends. D is the depth of the etching and corresponds to item 290.

In FIG. 10A and 10B, the cooling channels 200 are shown as being etched in silicon wafer 190. However, as mentioned in the discussion of FIG. 5, the cooling channels may also be etched in the heater chip 180.

Returning to the discussion of the center feed print head shown in FIG. 6, again the cooling channels 200 are shown as being embedded in silicon wafer 190. When the cooling channels are embedded in silicon wafer 190, they may be etched as provide in the alternate embodiments as shown in FIG. 2 or FIG. 3 and FIG. 4. However, the cooling channels 200 may also be etched directly in heater chip 190 as provided in alternate embodiment shown in FIG. 5.

Further in FIG. 6, the silicon wafer 190 is attached and supported by base 260. Silicon material 250 acts to form the input feed channel 130 and output feed channel 135 in combination with the base 260. Spacer material 240 is used to support both the heater chip 180 and the nozzle plate 170.

It should be noted that the silicon wafer 190 and the silicon material 250 are not limited to the use of silicon as a material. As would be appreciated by one of ordinary skill in the art, any material suitable to forming minute structures therein may be used in manufacturing silicon wafer 190 and silicon material 250, including plastic or metal.

Alternate Embodiment

Figure 7:
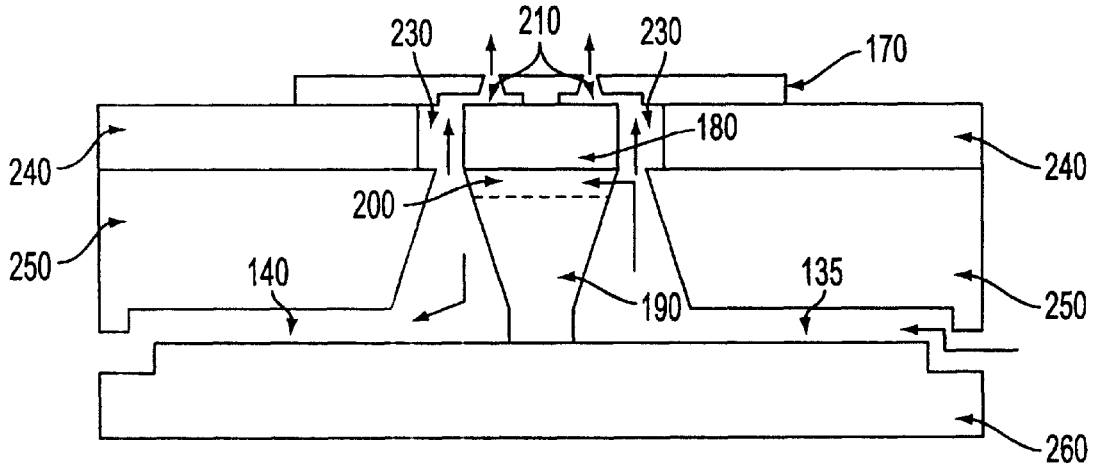
FIG. 7 is a diagram showing in detail the inkjet print head shown in FIG. 1 using edge feed channels and cooling channels according to an embodiment of the present invention.

FIG. 7 is a diagram showing in detail the print head 120 (shown in FIG. 1) using edge feed channels 230 and cooling channels 200 according to an embodiment of the present invention. The only difference between the print head 120 shown in FIG. 6 and that shown in FIG. 7 lies in the manner by which ink flows to the firing chambers 210 and the fact that the heater chip 180 is entirely supported by silicon wafer 190. In all other respects the operation of the print head 120 remains the same as that discussed in reference to FIG. 6.

In FIG. 7, ink enters the print head 120 through output feed channel 135 from pump 110 shown in FIG. 1. When the print head 120 is not actively printing, the ink, due to the pumping force from pump 110, proceeds through cooling channels 200 where the ink absorbs heat contained in the heater chip 180. The heated ink then proceeds through return channel 140 to ink reservoir 100 shown in FIG. 1.

As discussed earlier, in the preferred embodiment the pump 110 continuously operates whenever the inkjet printer is turned on. However, in an alternate embodiment discussed earlier a temperature sensor 150 (shown in FIG. 1) coupled to the printer CPU 160 (shown in FIG. 1) may be used to control pump 110 and only turn pump 110 on when the heater chip 180 exceeds a certain temperature.

Figure 8:
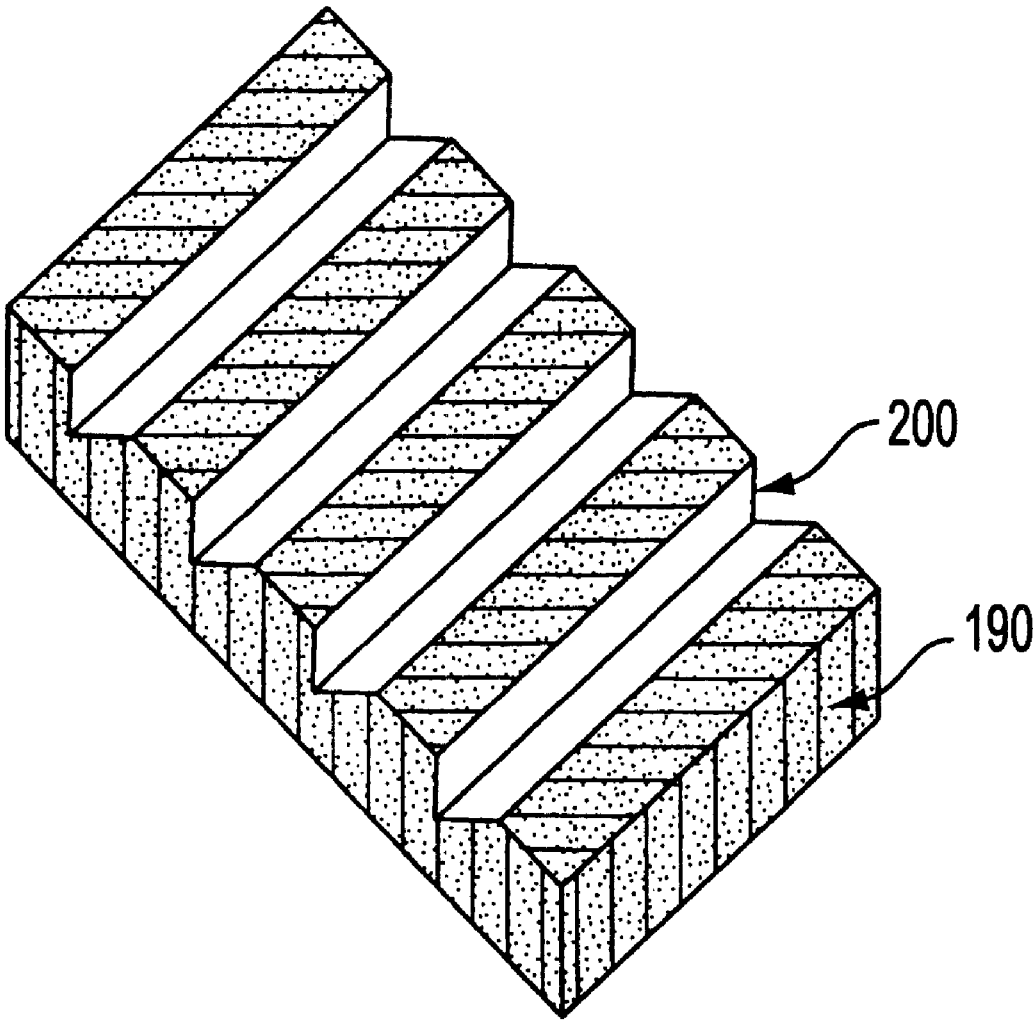
FIG. 8 is a diagram showing a three dimensional top view of cooling channels etched in a silicon wafer for use in an edge feed inkjet print head as shown in FIG. 7.

In FIG. 7, when the print head is actively printing, current is applied to heating elements (not shown) located in heater chip 180 which are immediately below firing chambers 210 located in the nozzle plate 170. The firing chambers 210 also contain holes or nozzles from which the ink is ejected onto the print medium when the ink reaches a vaporization temperature. The firing chambers 210 are refilled with ink by capillary feed through edge feed channel 230. Unlike FIG. 6, there is no need for a center feed channel 220 to exit in the silicon wafer 190. In the case of FIG. 7, the silicon wafer 190 need only be etched to contain the cooling channels 200 as shown in FIG. 8.

The sizing of the edge feed channels 230 versus the cooling channels 200 is again important in order to prevent undesired leakage of ink since the pump 110 may be pumping ink even when the print head is not printing. Ink is composed of primarily water and travels like current through the path of least resistance. In order to prevent ink from being forced out of the firing chambers 220 through the pumping action of pump 110, the edge feed channels 230 should be sized to apply sufficient resistance to prevent this. However, not so much resistance should be provided by the edge feed channels 230 that capillary feed of ink into the firing chambers 220 is defeated. A person of ordinary skill in the art would appreciate that sizing the cooling channels 200 should provide for the smooth flow of ink to the firing chambers 220, but that the firing chambers 220 along with their associated nozzles should be sized to provide sufficient resistance to prevent leakage therefrom due to the pumping action of pump 110.

Determining the volume of the edge feed channels 230 as shown in FIG. 7 is a matter of multiplying its height by its width since the edge feed channels are approximately rectangular in shape. When the cooling chambers 200 are formed by Potassium Hydroxide (KOH) solution etching, the sizing of cooling channels 200 can then be determined based on the formula W-entrance=W-exit+SQRT(2)*D. Referring to FIG. 10A and 10B, the cooling channels 200 are shown with two alternative embodiments of differing shape. In FIG. 10A and 10B, W-entrance corresponds to item 270 which is where the etching process would start. W-exit corresponds to item 280 and is the width where the etching ends. D is the depth of the etching and corresponds to item 290.

In FIG. 10A and 10B, the cooling channels 200 are shown as being etched in silicon wafer 190. However, as mentioned in the discussion of FIG. 5, the cooling channels may also be etched in the heater chip 180.

Returning to the discussion of the edge feed print head shown in FIG. 7, again the cooling channels 200 are shown as being embedded in silicon wafer 190. When the cooling channels are embedded in silicon wafer 190, they may be etched as provide in the alternate embodiments as shown in FIG. 2 or FIG. 3 and FIG. 4. However, the cooling channels 200 may also be etched directly in heater chip 190 as provided in alternate embodiment shown in FIG. 5.

Further in FIG. 7, the silicon wafer 190 is attached and supported by base 260. Silicon material 250 acts to form the input feed channel 130 and output feed channel 135 in combination with the base 260. Spacer material 240 is used to support the nozzle plate 170 and form the edge feed channels 230 in combination with the heater chip 180.

It should be noted that the silicon wafer 190 and the silicon material 250 are not limited to the use of silicon as a material. As would be appreciated by one of ordinary skill in the art, any material suitable to forming minute structures therein may be used in manufacturing silicon wafer 190 and silicon material 250, including plastic or metal.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A cooling system for an inkjet printer, comprising:

a print head having a plurality firing chambers, a feed channel, nozzles, and a heater chip, with cooling channels being formed in the heater chip, wherein when the inkjet printer is actively printing, ink is heated in the plurality of the firing chambers and ejected through the plurality of nozzles;

an ink reservoir containing ink; and a pump connected to the heater chip and the ink reservoir to pump the ink from the ink reservoir through the plurality of cooling channels in the heater chip in order to cool the heater chip and returning at least a portion of the ink to the ink reservoir.

2. A cooling system for an inkjet printer as recited in claim 1, wherein the pump continuously pumps ink through the cooling channels regardless of whether the inkjet printer is actively printing.

3. A cooling system for an inkjet printer as recited in claim 1, further comprising:

a temperature sensor connected to the heater chip to sense the temperature of the heater chip; and a processor connected to the temperature sensor and the pump to receive the temperature of the heater chip from the temperature sensor and to turn on the pump when the temperature of the heater chip exceeds a predetermined temperature range and to turn off the pump when the temperature of the heater chip drops below the predetermined temperature range, wherein the predetermined temperature range is an operating temperature range for the heater chip.

4. A cooling system for an inkjet printer as recited in claim 1, wherein the feed channel is a center feed channel connecting the cooling channels to the firing chambers, and wherein when the firing chambers cause the ejection of ink from the nozzles, the firing chambers are refilled by capillary feed through the cooling channels.

5. A cooling system for an inkjet printer as recited in claim 4, wherein the cooling channels are sized relative to the firing chambers and the nozzles to provide for smooth flow of ink through the center feed channel, whereby through this sizing of the cooling channels relative to the firing chambers and nozzles leakage from the print head is prevented.

6. A cooling system for an inkjet printer as recited in claim 1, wherein the feed channel is one of a plurality of edge feed channels connecting the ink reservoir to the firing chambers and connecting the ink reservoir to the cooling channels, and wherein when the firing chambers cause the ejection of ink from the nozzles the firing chambers are refilled by capillary feed from the ink reservoir.

7. A cooling system for an inkjet printer as recited in claim 6, wherein the cooling channels are sized relative to the firing chambers and the nozzles to provide for smooth flow of ink through the edge feed channels, whereby through this sizing of the cooling channels relative to the firing chambers and nozzles leakage from the print head is prevented.

8. A cooling system for an inkjet printer, comprising:

a nozzle plate having a plurality of nozzles and firing chambers formed therein;

a print head including the nozzle plate, a feed channel, and a heating chip, the heating chip having a plurality of heating elements positioned adjacent to the plurality of firing chambers, with cooling channels being formed in the heater chip, wherein when the inkjet printer is actively printing, ink is heated in the plurality of the firing chambers and ejected through the plurality of nozzles of the nozzle plate;

an ink reservoir containing ink; and a pump connected to the heater chip and the ink reservoir to pump the ink from the ink reservoir through the plurality of cooling channels in the heater chip in order to cool the heater chip and returning at least a portion of the ink to the ink reservoir.

9. A cooling system for an inkjet printer as recited in claim 8, wherein the pump continuously pumps ink through the cooling channels regardless of whether the inkjet printer is actively printing.

10. A cooling system for an inkjet printer as recited in claim 8, further comprising:

a temperature sensor connected to the heater chip to sense the temperature of the heater chip; and a processor connected to the temperature sensor and the pump to receive the temperature of the heater chip from the temperature sensor and to turn on the pump when the temperature of the heater chip exceeds a predetermined temperature range and to turn off the pump when the temperature of the heater chip drops below the predetermined temperature range, wherein the predetermined temperature range is an operating temperature range for the heater chip.

11. A cooling system for an inkjet printer as recited in claim 8, wherein the feed channel is a center feed channel connecting the cooling channels to the firing chambers, and wherein when the firing chambers cause the ejection of ink from the nozzles, the firing chambers are refilled by capillary feed through the cooling channels.

12. A cooling system for an inkjet printer as recited in claim 11, wherein the cooling channels are sized relative to the firing chambers and the nozzles to provide for smooth flow of ink through the center feed channel, whereby through this sizing of the cooling channels relative to the firing chambers and nozzles leakage from the print head is prevented.

13. A cooling system for an inkjet printer as recited in claim 8, wherein the feed channel is one of a plurality of edge feed channels connecting the ink reservoir to the firing chambers and connecting the ink reservoir to the cooling channels, and wherein when the firing chambers cause the ejection of ink from the nozzles, the firing chambers are refilled by capillary feed from the ink reservoir.

14. A cooling system for an inkjet printer as recited in claim 13, wherein the cooling channels are sized relative to the firing chambers and the nozzles to provide for smooth flow of ink through the edge feed channels, whereby through this sizing of the cooling channels relative to the firing chambers and nozzles leakage from the print head is prevented.

15. A cooling system for an inkjet printer as recited in claim 8, wherein the feed channel is one of a plurality of edge feed channels connecting the ink reservoir to the firing chambers and connecting the ink reservoir to the cooling channels, and wherein when the firing chambers cause the ejection of ink from the nozzles, the firing chambers are refilled by capillary feed from the ink reservoir.

16. A cooling system for an inkjet printer as recited in claim 15, wherein the cooling channels are sized relative to the firing chambers and the nozzles to provide for smooth flow of ink through the edge feed channels, whereby through this sizing of the cooling channels relative to the firing chambers and nozzles leakage from the print head is prevented.

17. A cooling system for an inkjet printer, comprising:

a nozzle plate having a plurality of nozzles and firing chambers formed therein;

a print head including the nozzle plate, a feed channel, and a heater chip, the heater chip having a plurality heating elements positioned adjacent to the plurality of firing chambers, with cooling channels being formed in the heater chip, wherein when the inkjet printer is actively printing, ink is heated in the plurality of firing chambers and ejected through the plurality of nozzles of the nozzle plate;

an ink reservoir containing ink;

a pump connected to the heater chip and the ink reservoir to pump the ink from the ink reservoir through the plurality of cooling channels in the heater chip in order to cool the heater chip and returning at least a portion of the ink to the ink reservoir;

a temperature sensor connected to the heater chip to sense the temperature of the heater chip; and a processor connected to the temperature sensor and the pump to receive the temperature of the heater chip from the temperature sensor and to turn on the pump when the temperature of the heater chip exceeds a predetermined temperature range and to turn off the pump when the temperature of the heater chip drops below the predetermined temperature range, wherein the predetermined temperature range is an operating temperature range for the heater chip.

18. A cooling system for an inkjet printer as recited in claim 17, wherein the feed channel is a center feed channel connecting the cooling channels to the firing chambers, and wherein when the firing chambers cause the ejection of ink from the nozzles, the firing chambers are refilled by capillary feed through the cooling channels.

19. A cooling system for an inkjet printer as recited in claim 18, wherein the cooling channels are sized relative to the firing chambers and the nozzles to provide for smooth flow of ink through the center feed channel, whereby through this sizing of the cooling channels relative to the firing chambers and nozzles leakage from the print head is prevented.

* * * * *